US009409275B2

(12) United States Patent
Ownby et al.

(10) Patent No.: US 9,409,275 B2
(45) Date of Patent: Aug. 9, 2016

(54) MATERIAL REMOVAL SYSTEM FOR USE WITH ARTICLES HAVING VARIATIONS IN FORM

(75) Inventors: Clayton A. Ownby, Houston, TX (US); David W. Darling, Tomball, TX (US); Mark E. Ganninger, Leander, TX (US); Philip Courtois, Pflugerville, TX (US)

(73) Assignees: Halliburton Energy Services, Inc., Houston, TX (US); Design & Assembly Concepts, Inc., Leander, TX (US)

( * ) Notice: Subject to any disclaimer, the term of this patent is extended or adjusted under 35 U.S.C. 154(b) by 895 days.

(21) Appl. No.: 13/329,125

(22) Filed: Dec. 16, 2011

(65) Prior Publication Data

US 2013/0152356 A1 Jun. 20, 2013

(51) Int. Cl.
*B24B 27/04* (2006.01)
*B24B 27/00* (2006.01)

(52) U.S. Cl.
CPC ..... *B24B 27/0038* (2013.01); *B24B 27/04* (2013.01); *Y10T 29/49764* (2015.01); *Y10T 29/53022* (2015.01)

(58) Field of Classification Search
CPC ..... B24B 27/0038; B24B 27/04; Y10T 29/49764; Y10T 29/53022
USPC ..... 29/26 R, 26 A, 26 B, 56.5; 73/627, 629; 76/108.1; 703/7
See application file for complete search history.

(56) References Cited

U.S. PATENT DOCUMENTS 5,077,941 A 1/1992 Whitney
5,448,146 A 9/1995 Erlbacher
5,506,682 A 4/1996 Pryor
6,368,012 B1 4/2002 St. Onge et al.
6,873,880 B2 3/2005 Hooke et al.
7,631,560 B2 * 12/2009 Lund et al. ..... 73/629
7,778,777 B2 8/2010 Chen
7,954,380 B2 * 6/2011 Lund et al. ..... 73/629
8,374,835 B2 * 2/2013 Lind et al. ..... 703/7
8,738,342 B2 * 5/2014 Lind ..... E21B 41/00 703/10
2007/0289385 A1 * 12/2007 Kiuchi ..... 73/627
2010/0282026 A1 * 11/2010 Luce et al. ..... 76/108.1
2011/0209539 A1 9/2011 Beckstead et al.

OTHER PUBLICATIONS

Pushcorp, Inc.; "1000 Series Adjustable Force Device", product manual, dated Apr. 2001, 16 pages.
Pushcorp, Inc.; "1000 Series Adjustable Force Device", online product article, receive on Nov. 10, 2011, 4 pages.
(Continued)

*Primary Examiner* — Richard Chang
(74) *Attorney, Agent, or Firm* — Baker Botts L.L.P.

(57) ABSTRACT

A method of removing unwanted material from an article having a variable form can include scanning the article and determining, based on the scanning, a location of the unwanted material, determining tool paths of a cutting tool which will result in removal of the unwanted material, and displacing the cutting tool along the tool paths, thereby removing the unwanted material. A material removal system for removing unwanted material from an oilfield drill bit can include a rotary indexing device which rotates the drill bit about a longitudinal axis of the drill bit, a scanning device which scans an outer surface of the drill bit, and a controller which determines a geometry of the drill bit, based on at least one scan by the scanning device, determines a location of the unwanted material, and determines tool paths of a cutting tool for removal of the unwanted material.

34 Claims, 9 Drawing Sheets

(56) References Cited

OTHER PUBLICATIONS

Lester E. Goodwin, Pushcorp, Inc.;"Controller Interfaces for Robotic Surface Finishing Applications", presentional paper, dated Oct. 1998, 9 pages.
Brian J. Davidson; "A Rotating Buffer System for On-line Collection of Eye Monitor Data", published in the Behavior Research Methods & Instrumentation, vol. 13, No. 2, pp. 112-114, dated 1981, 3 pages.
E. Lughofer; "Evolving Fuzzy Systems—Method", Studfuzz 226, pp. 1-42, dated 2011, 42 pages.
Edwin A. Erlbacher; "Force Control Basics", Informative paper, received Nov. 10, 2011, 14 pages.
C.H. Liu, A. Chen, Y.-T. Wang, C.-C. A. Chen; "Modeling and Simulation of an Automatic Grinding System Using a Hand Grinder", Article for Int. J. Adv. Manuf. Technol vol. 23, pp. 874-881, dated Mar. 10, 2004, 8 pages.
Hamid Nasri, Gunnar Bolmsjo; "A Process Model for Robotic Disc Grinding", Article for Int. J. Mach. Tools Manufact. vol. 35, No. 4, pp. 503-510, dated May 19, 1994, 8 pages.
Berend Denkena, Heldge Henning; "Multicriteria Dimensioning of Hard-Finishing Operations Regarding Cross-Process Interdependencies", Article for J. Tell. Manuf., dated Nov. 26, 2010, 10 pages.
D. Utsumi, et al.; "Motor Coordination of Masseter and Temporalis Muscle During Mastication in Mice", Article for International journal of Stomatology & Occlusion Medicine, pp. 187-194, dated Dec. 22, 2010, 8 pages.
Yixu Song, et al.; "A Method for Grinding Removal Control of a Robot Belt Grinding System", J Intel' Manuf, DOI 10.1007/s10845-011-0508-6, dated Feb. 13, 2011, 11 pages.
Michael D. Uchic, et al.; "Automated Serial Sectioning Methods for Rapid Collection of 3-D Microstructure Data", Overview, Large Datasets in Materials Science, Part 1, vol. 63, No. 3, dated Mar. 2011, 5 pages.
Victor S. Cheng, et al.; "Laser Vision System Based on Synchronized Scanning Method", lecture notes, vol. 362, pp. 83-89, dated 2007, 7 pages.
Intelligent Robot Solutions; "M-900iA",Payload:200-700KG company brochure, dated 2010, 4 pages.
Xun Chen; "Machine Dynamics in Grinding Processes", Chapter 8, pp. 233-262, received Jan. 2012, 30 pages.
L.C. Zhang; "Surface Integrity of Materials Induced by Grinding", Chapter 5, pp. 245-267, dated 2011, 24 pages.
Werner Kroeninger; "Thin Die Production", Chapter 6, pp. 219-242, dated 2009, 24 pages.
Bjorn Solvang, et al.; "Vision Based Robot Programming", Paper for the Network, Sensing and Control Conference, pp. 949-954, dated 2008, 6 pages.
Klaus Weinert; "Simulation Based Optimization of the Nc-Shape Grinding Process with Toroid Grinding Wheels", Production Process, pp. 245-252, dated Jun. 29, 2007, 8 pages.
Lester E. Godwin; "Programming with Force Control", paper presented at the RIA Grinding, Deburring and Finishing Workshop, dated Jun. 1996, 10 pages.
Pushcorp, Inc.; "Success Stories", details of successful customer applications with PushCorp process equipment, dated Nov. 10, 2011, 3 pages.
Fanuc Tobotics; "R-2000113/200T", company brochure, dated Aug. 2006, 2 pages.
National Instruments; "What is NI LabVIEW", Product Information via http://www.ni.com/labview/whatis/, dated Nov. 10, 2011, 3 pages.
David P. Casasent; "Intelligent Robots and Computer Vision XI: Algorithms, Techniques, and Active Vision", (Proceedings Volume), Proceedings of SPIE Volume: 1825, dated Nov. 16-18, 1992, 792 pages.

* cited by examiner

MATERIAL REMOVAL SYSTEM FOR USE WITH ARTICLES HAVING VARIATIONS IN FORM

BACKGROUND

This disclosure relates generally to material removal systems and, in one example described below, more particularly provides an automated material removal system for use with custom manufactured oilfield drill bits.

Extensive personal protection equipment can be required for an operator to remove unwanted material from custom molded, cast or forged articles. However, the fact that the articles are custom manufactured prevents the use of typical automated material removal systems for removal of the unwanted material. For example, precise tool paths cannot be programmed into such a system, accounting for all possible variations in the articles.

Therefore, it will be appreciated that improvements are needed in the art of constructing material removal systems. Such improvements could be used for removing unwanted material from custom manufactured articles, or from other types of articles.

DETAILED DESCRIPTION

Figure 1:
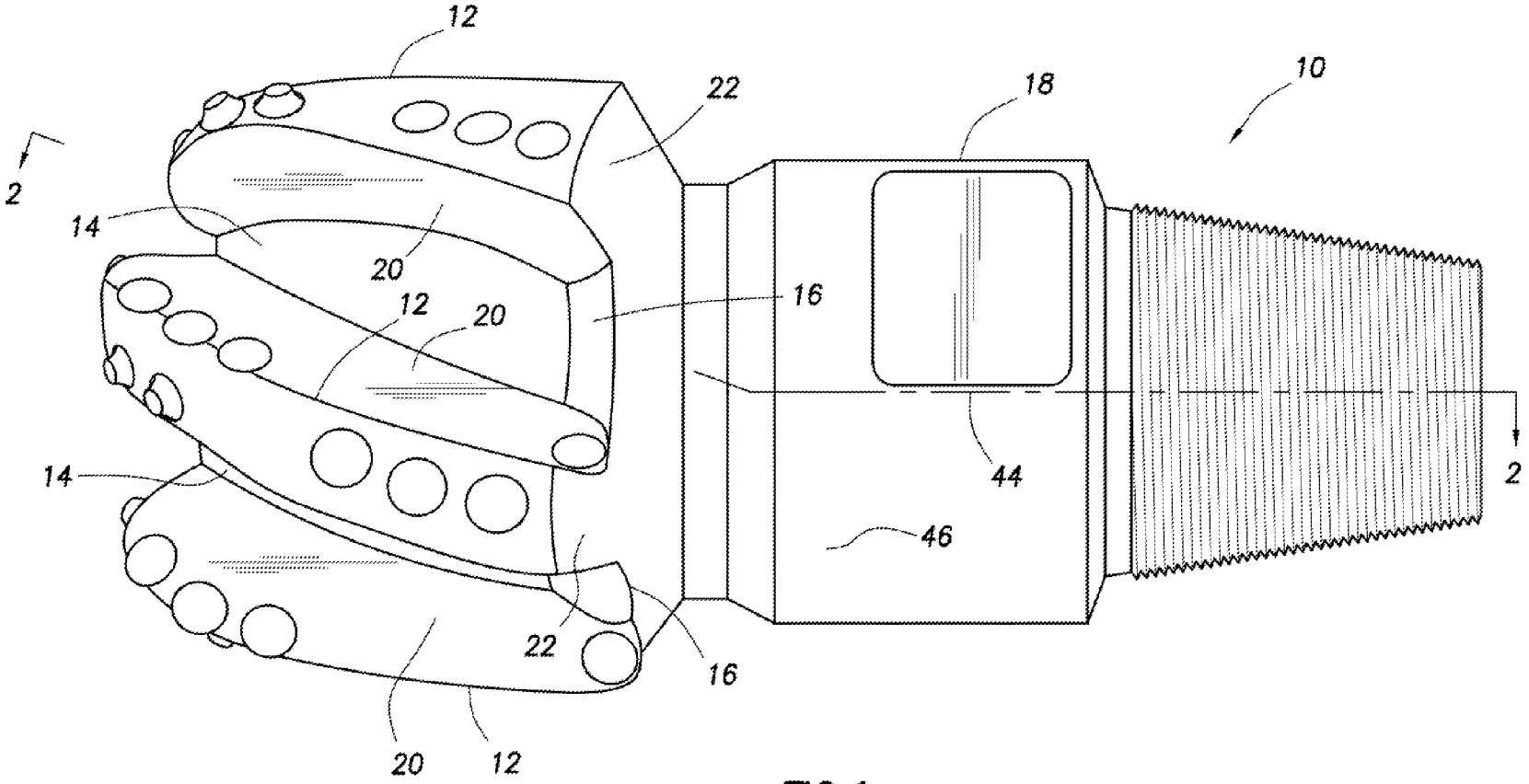
FIG. 1 is a representative side view of an oilfield drill bit.
Figure 2:
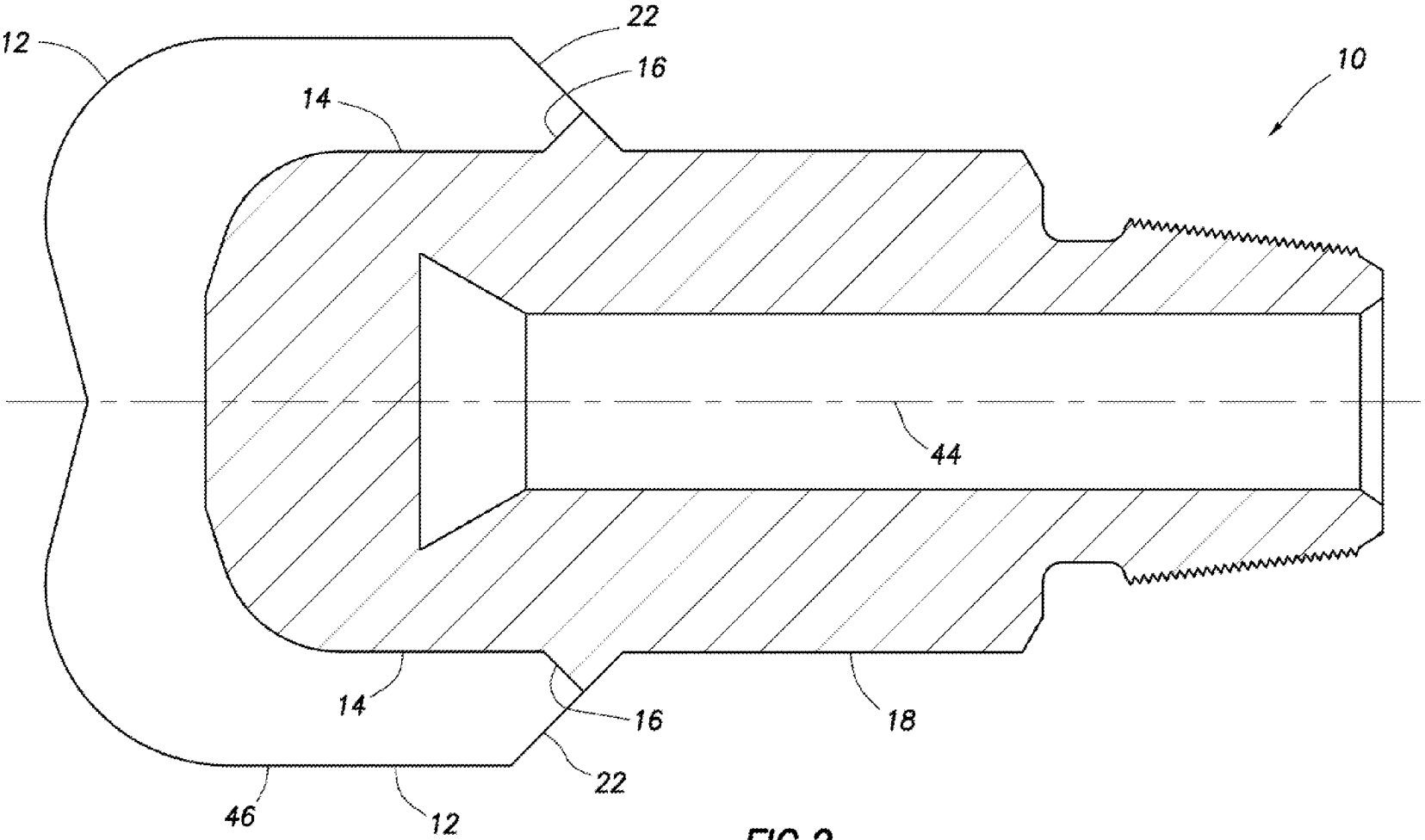
FIG. 2 is a representative cross-sectional view of the drill bit, taken along line 2-2 of FIG. 1.

Representatively illustrated in FIGS. 1 & 2 is a drill bit 10 of the type used to drill wellbores through subterranean formations. The drill bit 10 is an example of an article which can benefit from having unwanted material thereon removed using a material removal system and method described below.

However, it should be clearly understood that the drill bit 10 is merely one of a wide variety of different types of articles which can benefit from the principles of this disclosure. Such articles are not necessarily limited to the oilfield. In particular (but not exclusively), articles which are cast, molded or forged, with significant variations in the articles, can most benefit from the principles described here, but the scope of this disclosure is not limited to cast, molded or forged articles.

Oilfield articles which can benefit from this disclosure's principles can comprise fixed cutter bits (such as the drill bit 10 depicted in FIGS. 1 & 2), roller cone bits, coring bits, side picket mandrels, welded-together components (e.g., to remove excess weld material), hard facing, etc. Therefore, it will be appreciated that the scope of this disclosure is not limited to any of the details of the drill bit 10, or of the material removal system and method described below for use with the drill bit.

The drill bit 10 has multiple generally helically formed blades 12, with recesses 14 (known as "junk slots") between the blades. Note that, in other examples, the blades 12 may not be helically formed.

In an as-molded configuration as depicted in FIGS. 1 & 2, the drill bit 10 also has unwanted material 16 between the blades 12, which unwanted material could interfere with flow of fluids and cuttings through the recesses 14. Therefore, the unwanted material 16 should be removed.

One problem with removing the material 16 using typical conventional automated material removal systems is that, in this example, the drill bit 10 is custom manufactured, with a certain geometry designed to suit a particular use of the drill bit. Thus, it would be impractical and inefficient in a relatively high volume manufacturing operation to produce custom programming for an automated material removal system each time a custom drill bit is manufactured.

Another problem with removing the material 16 using typical conventional automated removal systems is that, even if many of the custom designed drill bits 10 are manufactured, the molding process induces variations in the form of the blades 12, the location of the unwanted material, etc. Thus, even if an automated material removal system were programmed with the geometry of the drill bit 10, that geometry can change from bit to bit in practice, and so the system would not be able to adequately remove the unwanted material, without removing any wanted material (e.g., the blade 12 material, material of a shank 18 of the bit, etc.).

Figure 3:
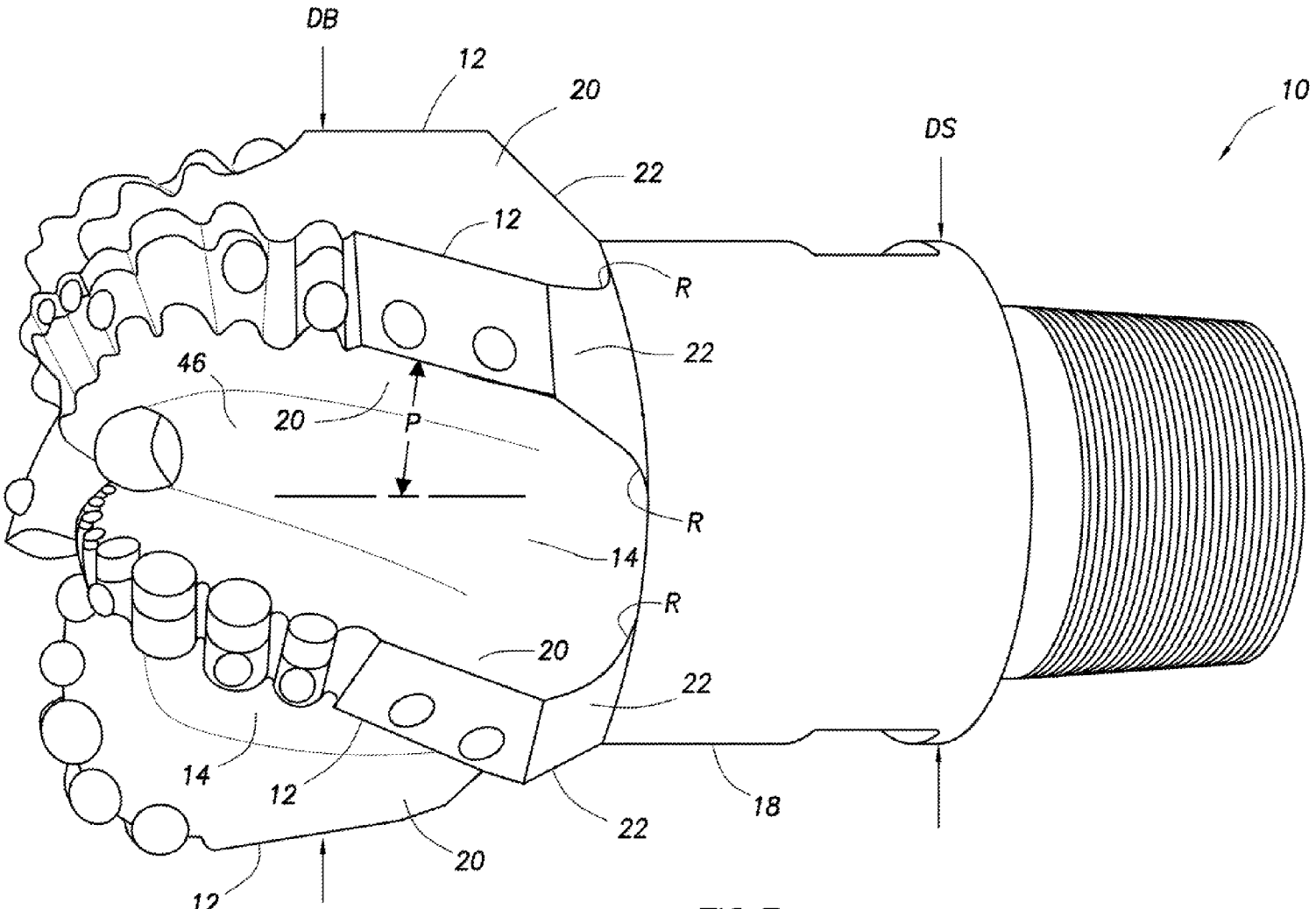
FIG. 3 is a representative side view of another example of the oilfield drill bit.
Figure 4:
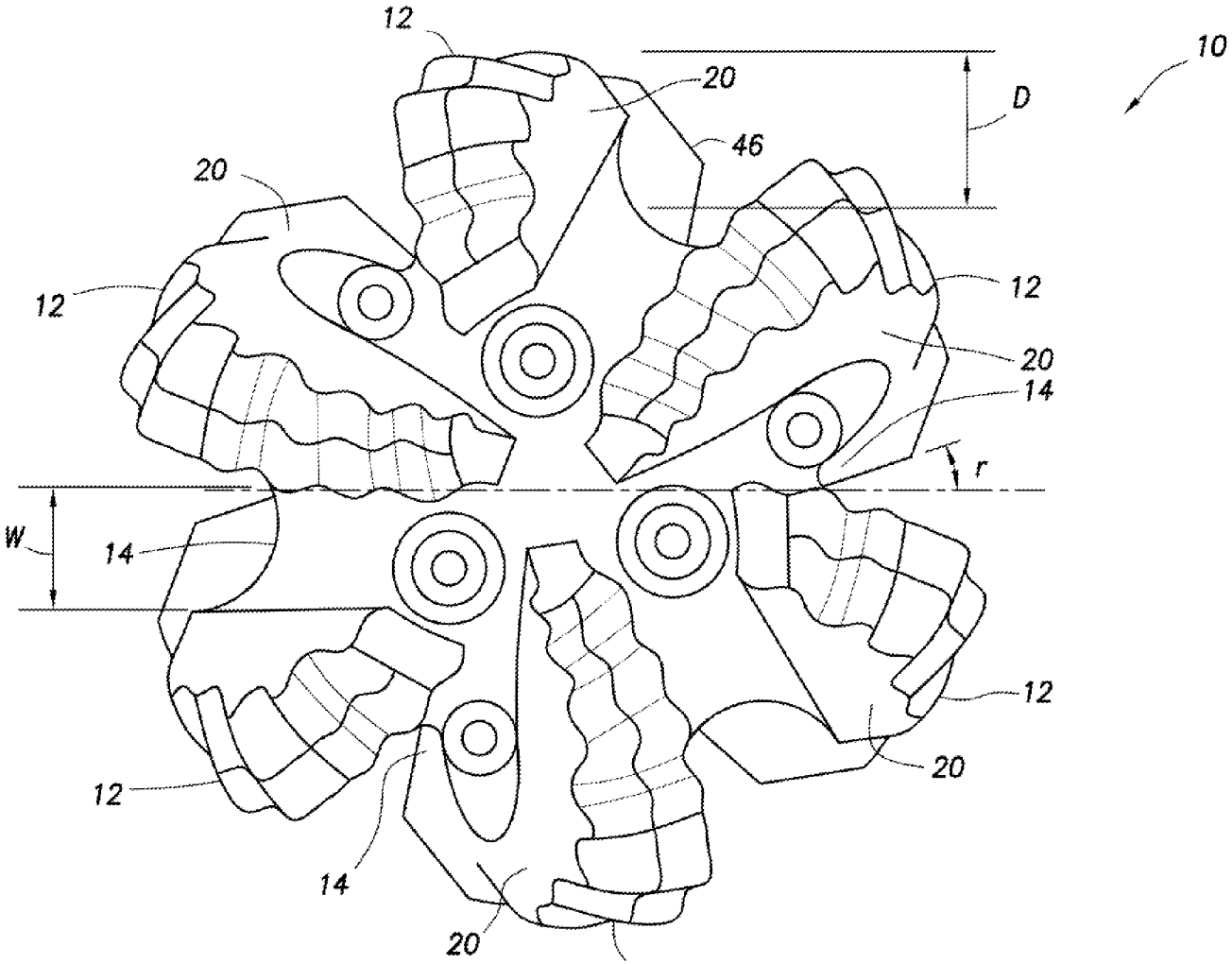
FIG. 4 is a representative end view of the FIG. 3 example.

Referring additionally now to FIGS. 3 & 4, another example of the drill bit 10 is representatively illustrated, with the unwanted material 16 removed. In this example, it may be seen that the blades 12 of the drill bit 10 have a helical pitch P, a radius R between each recess and sides 20 of adjacent blades, a width W between the blades, a depth D of the recess between the blades, a diameter DB of the blades, a diameter DS of the shank 18 and a bevel 22 between the blades and the shank.

It will be appreciated that, in order to determine the location of the unwanted material 16, the geometry of the drill bit 10 should be determined (including, for example, the number and locations of the blades 12 and recesses 14, the pitch P, the radius R between each recess and the sides 20 of adjacent blades, the width W between the blades, the depth D of the recess between the blades, the diameter DB of the blades, the diameter DS of the shank 18, the bevel 22 between the blades and the shank, the location of the unwanted material, etc.). By determining the geometry of the drill bit 10 prior to the cutting operation, appropriate tool paths for displacement of a cutting tool relative to the drill bit can be determined, even though there may be variations in form of the drill bit.

Figure 5:
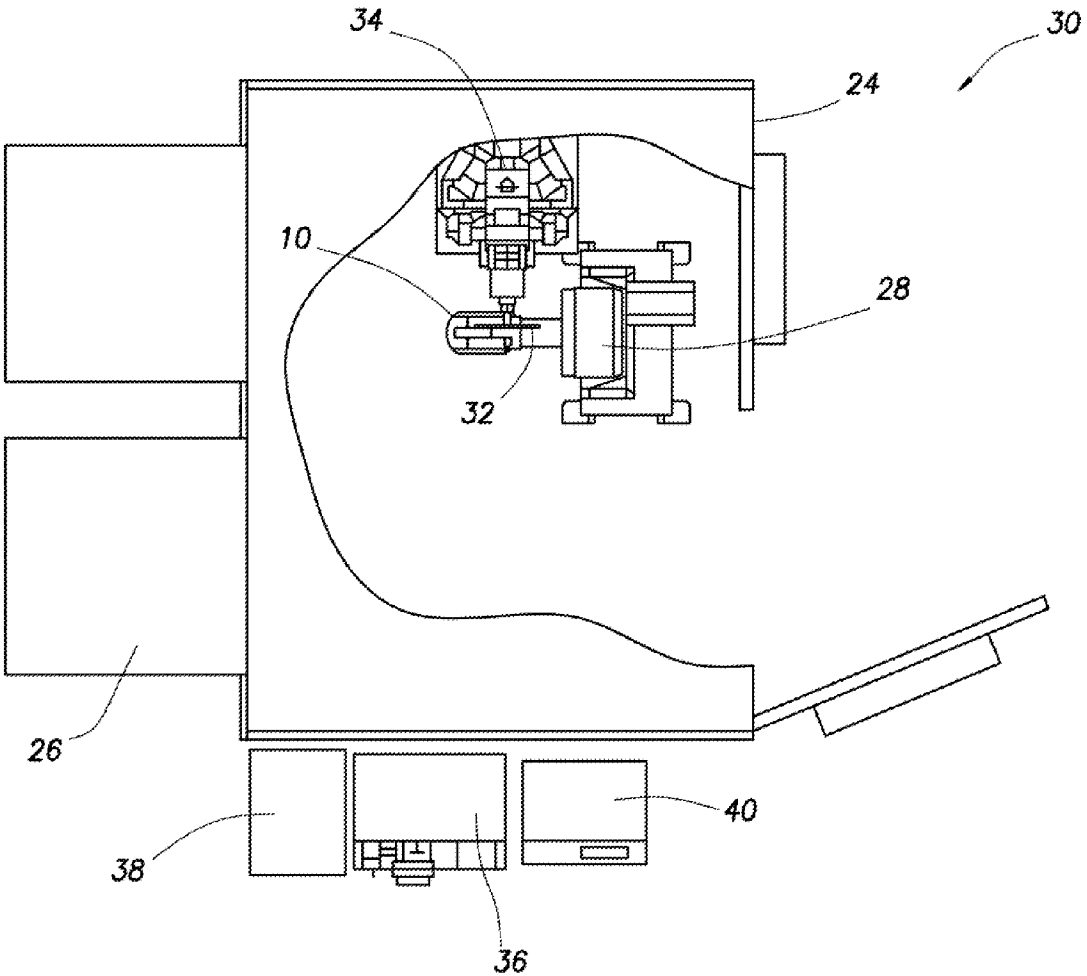
FIG. 5 is a representative top view of a material removal system which can embody principles of this disclosure.

Referring additionally now to FIG. 5, a plan view of a material removal system 30, and an associated method, which can embody principles of this disclosure is representatively illustrated. The system 30 in this example is configured for removing the unwanted material 16 from between the blades 12 of the drill bit 10. However, in other examples, the system 30 could be used to remove unwanted material from other types of articles.

As depicted in FIG. 5, the system 30 includes an enclosure 24 having a dust collector 26 for removing grinding dust, etc. from within the enclosure. The drill bit 10 is mounted in an axial indexing device 28 in the enclosure 24. A cutting tool 32 (in this example, a grinding wheel) is displaced by a robot 34 along tool paths determined by a controller 36.

The controller 36 can comprise at least one processor, memory devices and suitable programming for performing various functions. A suitable controller for use in the system 30 is a Model R30iA Controller manufactured by Fanuc Robotics, although other types of controllers may be used, if desired.

The system 30 also includes an operator terminal or user interface 38 (such as, an industrial computer with a display and an input device). A spindle chiller 40 draws heat from a spindle carrying the cutting tool 32.

Figure 6:
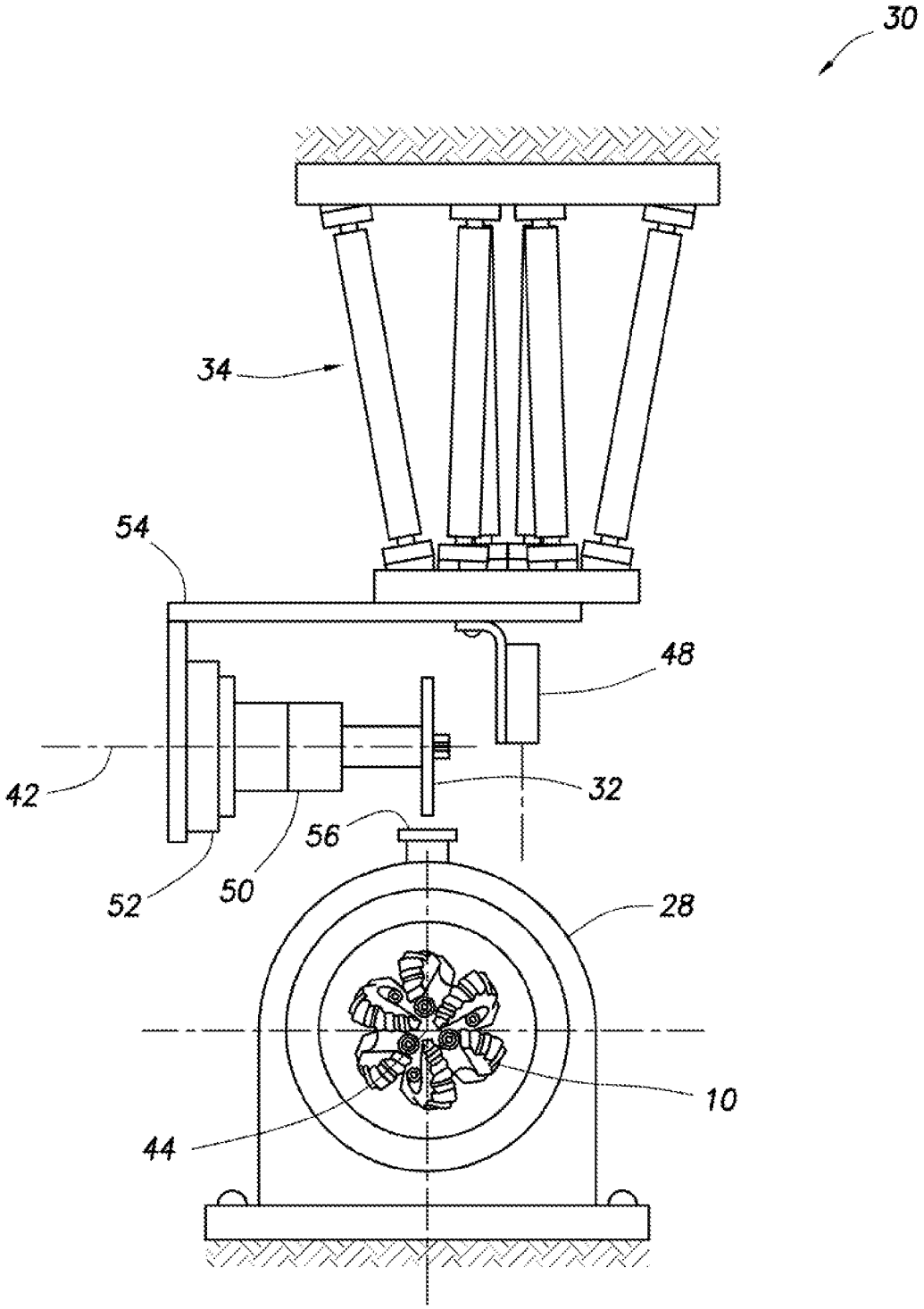
FIG. 6 is a representative elevational view of certain components of the material removal system.

Referring additionally now to FIG. 6, an elevational view of certain components of the system 30 is representatively illustrated. In this view, it may be seen that an axis 42 about which the cutting tool 32 rotates is oriented perpendicular to a longitudinal axis 44 of the drill bit 10 when the drill bit is mounted in the rotary indexing device 28.

The robot 34 is of the six-axis type having multiple linear actuators. A suitable robot for use in the system 30 is a Model F-200iB manufactured by Fanuc Robotics of Rochester Hills, Mich. USA. Other robots, and other types of robots, may be used in keeping with the scope of this disclosure. Operation of the robot 34 is controlled by the controller 36.

The rotary indexing device 28 rotates the drill bit 10 as needed to allow a scanning device 48 to appropriately scan an outer surface 46 of the bit (see FIGS. 1-4), and to allow the cutting tool 32 to remove the unwanted material 16 from the bit. A suitable rotary indexing device for use in the system 30 is a Single Axis Positioner manufactured by Fanuc Robotics, although other rotary indexing devices may be used, if desired.

The scanning device 48 is used to determine the geometry of the drill bit 10 by scanning the outer surface 46 of the bit using certain techniques described more fully below. A suitable scanning device for use in the system 30 is a laser sensor with a dust tight, positively-pressured laser enclosure, a pneumatic shutter and hard guarding of the laser from collisions. Other types of scanning devices which may be used include radar, an ultrasound sensor, a physical probe and an optical scanning device (e.g., other than a laser), etc.

The cutting tool 32 is mounted to a spindle extending from a servo motor 50. The servo motor 50 is mounted to an adjustable force device or active compliant tool 52. A suitable active compliant tool for use in the system 30 is the 1000 Series Adjustable Force Device manufactured by PushCorp, Inc. of Dallas, Tex. USA, although use of the tool 52 is not necessary in the system, and other types of active compliant tools may be used in keeping with the scope of this disclosure.

A carriage 54 is used to mount the cutting tool 32, device 48, motor 50 and tool 52 to the robot 34. In this manner, the cutting tool 32 and scanning device 48 can be displaced with six degrees of freedom (rotated and displaced along each of three axes) relative to the drill bit 10.

In addition, the drill bit 10 can be rotated as desired relative to the robot 34, cutting tool 32 and scanning device 48. Since the robot 34 can manipulate the cutting tool 32 and scanning device 48 with six degrees of freedom, it is not necessary to rotate the drill bit 10 for the cutting tool and scanning device to adequately access the outer surface 46 of the drill bit. However, it is advantageous in the FIGS. 5 & 6 example to rotate the drill bit 10 for most convenient access to the outer surface 46 by the cutting tool 32 and scanning device 48.

A horizontal plate 56 is provided at a known location for measuring a diameter of the cutting tool 32. The robot 34 can position the cutting tool 32 above the plate 56, and then slowly lower the cutting tool until it contacts the plate. The device 52 senses this contact (resulting in a force applied to the cutting tool 32), and the controller 36 determines the diameter of the cutting tool, based on the position of the robot 34 when the contact occurs. Alternatively, the device 52 can sense deflection due to the contact in addition to, or instead of, sensing the actual contact to determine the diameter of the cutting tool 32.

The cutting tool 32 in this example is a grinding wheel. The grinding wheel abrasively removes the unwanted material 16 from between the blades 12. However, in other examples, the cutting tool 32 could comprise a circular mill or another type of cutting device.

Figure 7:
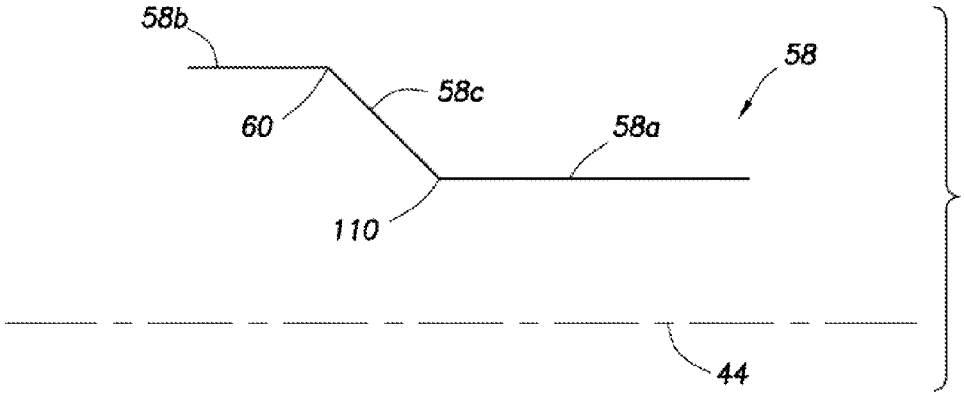
FIG. 7 is a representative axial scan of the drill bit.

Referring additionally now to FIG. 7, a representative scan 58 produced by the scanning device 48 is illustrated. The scan 58 is produced by the robot 34 displacing the scanning device 48 axially along the outer surface 46 of the drill bit 10, so that a blade 12 is axially traversed at least partially by the scan.

The axial scan 58 as depicted in FIG. 7 includes a section 58*a* which indicates the diameter DS of the shank 18, a section 58*b* which indicates the diameter DB of a blade 12, and a section 58*c* which indicates the bevel 22. The controller 36 can use the data from the axial scan 58 to determine the bit and shank diameters DB, DS, and the location and angle of the bevel 22. Of interest in this example is locating a top 60 of the bevel 22 since, in a method described below, the top of the bevel can be used to determine the location of the blades 12 and the unwanted material 16.

Figure 8:
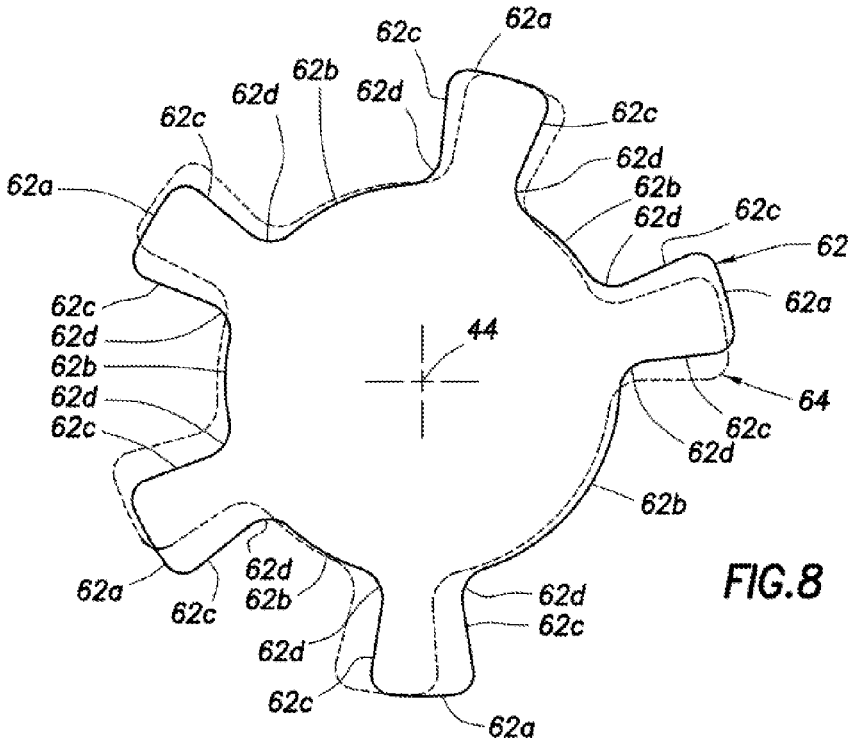
FIG. 8 is are representative circumferential scans of the drill bit.

Referring additionally now to FIG. 8, a representative circumferential scan 62 is illustrated. The scan 62 is produced in this example by the rotary indexing device 28 rotating the drill bit 10, so that the blades 12 are traversed by the scan.

Many geometry characteristics of the drill bit 10 can be determined by the controller 36 from the data in the scan 62. The number of the blades 12 and recesses 14 is readily determined, based on the circumferential scan 62. The blade diameters DB and angular positions of the blades 12 are indicated by sections 62*a* of the scan 62, the positions of the recesses 14 are indicated by sections 62*b*, the rakes of the blade sides 20 are indicated by sections 62*c*, the widths W between adjacent blades 12 are indicated by the distances between the sections 62*c*, the depths D of the recesses 14 are indicated by differences between the sections 62*a* & *b*, radii R between the recesses 14 and adjacent sides of the blades are indicated by sections 62*d*. In effect, the circumferential scan 62 gives a lateral cross-sectional representation of the drill bit 10 at a certain axial position along the bit.

To determine how the geometry of the blades 12 changes along their length, another circumferential scan 64 is performed at another axial position. By determining the change in angular positions of the blades 12 between the two circumferential scans 62 & 64, the helical pitch P of the blades can be readily calculated. The helical pitch P may be expressed in angular units (e.g., relative to the longitudinal axis 44, as in FIG. 3), or in any other units.

The controller 36 can identify the various sections of the circumferential scans 62, 64, and compare the scans to determine the geometrical characteristics of the drill bit 10. Data manipulation techniques may be used, e.g., data validation, averaging measurements, etc., to produce accurate geometrical information on the drill bit 10, from which appropriate tool paths for the cutting tool 32 can be determined.

Figure 9:
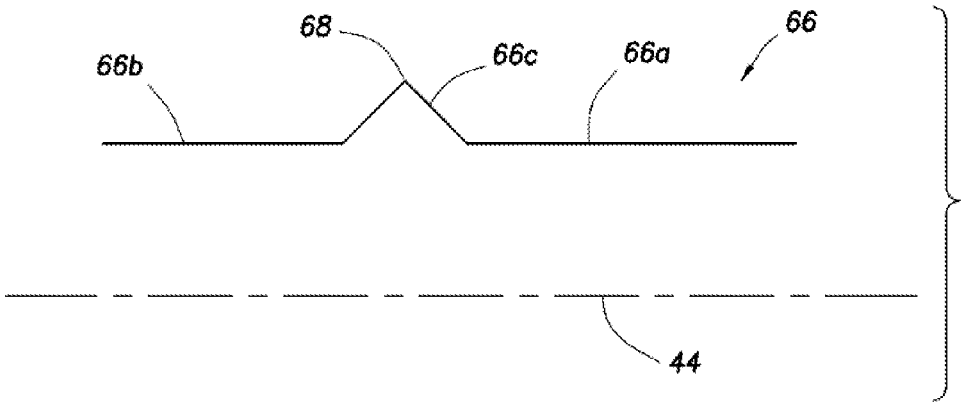
FIG. 9 is a representative helical scan of an unwanted web of the drill bit.

Referring additionally now to FIG. 9, another scan 66 is performed by the scanning device 48. The scan 66 in this example helically traverses the drill bit 10 outer surface 46 between the shank 18 and a recess 14. In this manner, the scan 66 also traverses the unwanted material 16 between the blades 12.

This scan 66 is performed after the circumferential scans 62, 64 so that the helical pitch P and the angular positions of the blades 12 are known prior to the scan 66. With the positions and pitches P of the blades 12 known, the controller 36 can direct the robot 34 to displace the scanning device 48 axially while the rotary indexing device 28 rotates the drill bit 10, thereby helically scanning between the shank 18 and a recess 14.

The scan 66 includes a section 66*a* (similar to the section 58*a* in FIG. 7) which indicates the shank diameter DS, a section 66*b* (similar to the sections 62*b*) which indicates the depth of the recess 14, and a section 66*c* which indicates the unwanted material 16 between the blades 12. Preferably, a peak of the section 66*c* can be identified as a peak 68 of the corresponding unwanted material 16.

The controller 36 can determine from the scans 58, 62, 64, 66 the various geometrical characteristics of the drill bit 10, including the location of the unwanted material 16 between the blades 12. To remove this unwanted material 16, the controller 36 can determine appropriate tool paths of the cutting tool 32 which will result in removal of the unwanted material, without removing any of the wanted material of the drill bit 10.

Figure 10A:
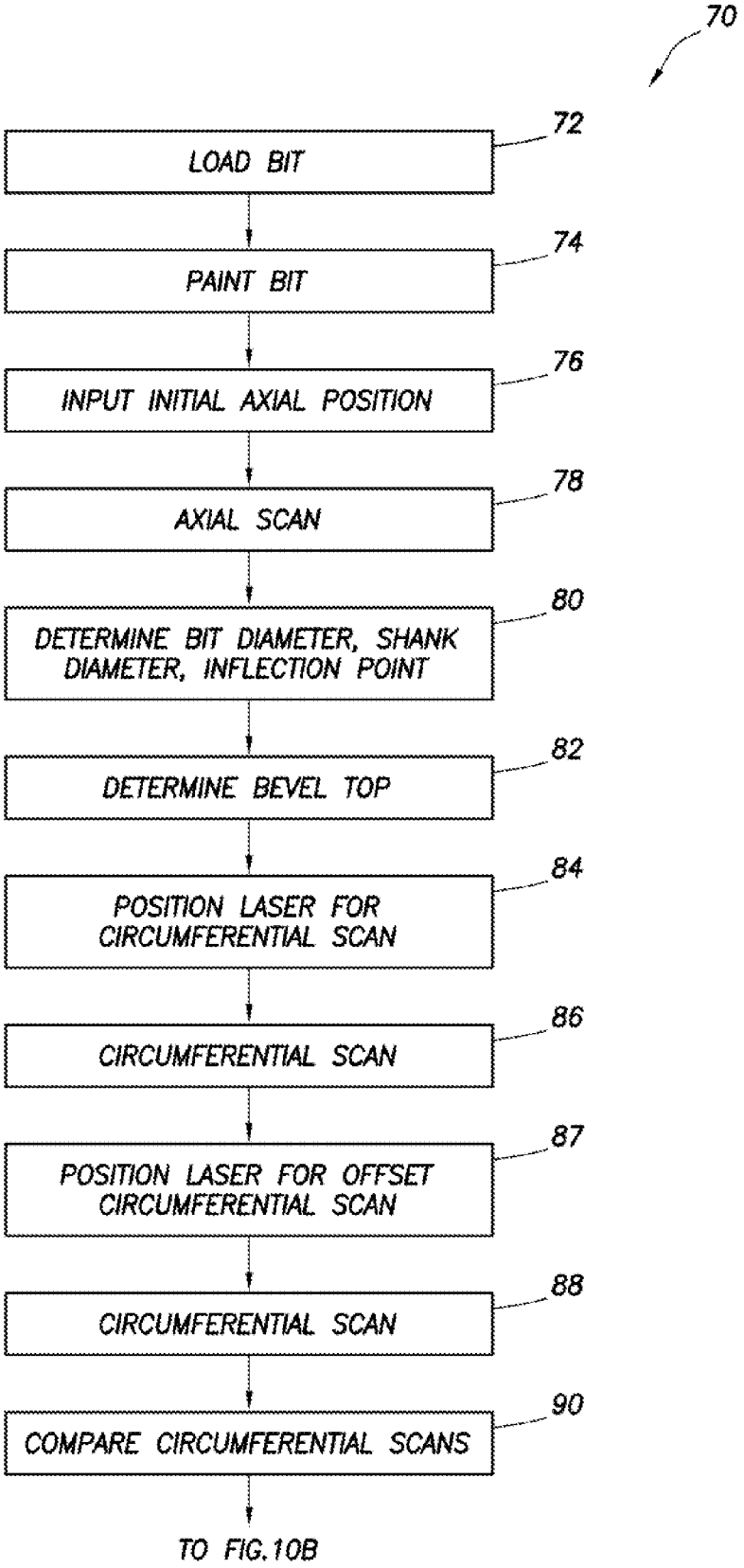
FIGS. 10 A & B comprise a representative flowchart for a method which can embody principles of this disclosure.
Figure 10B:
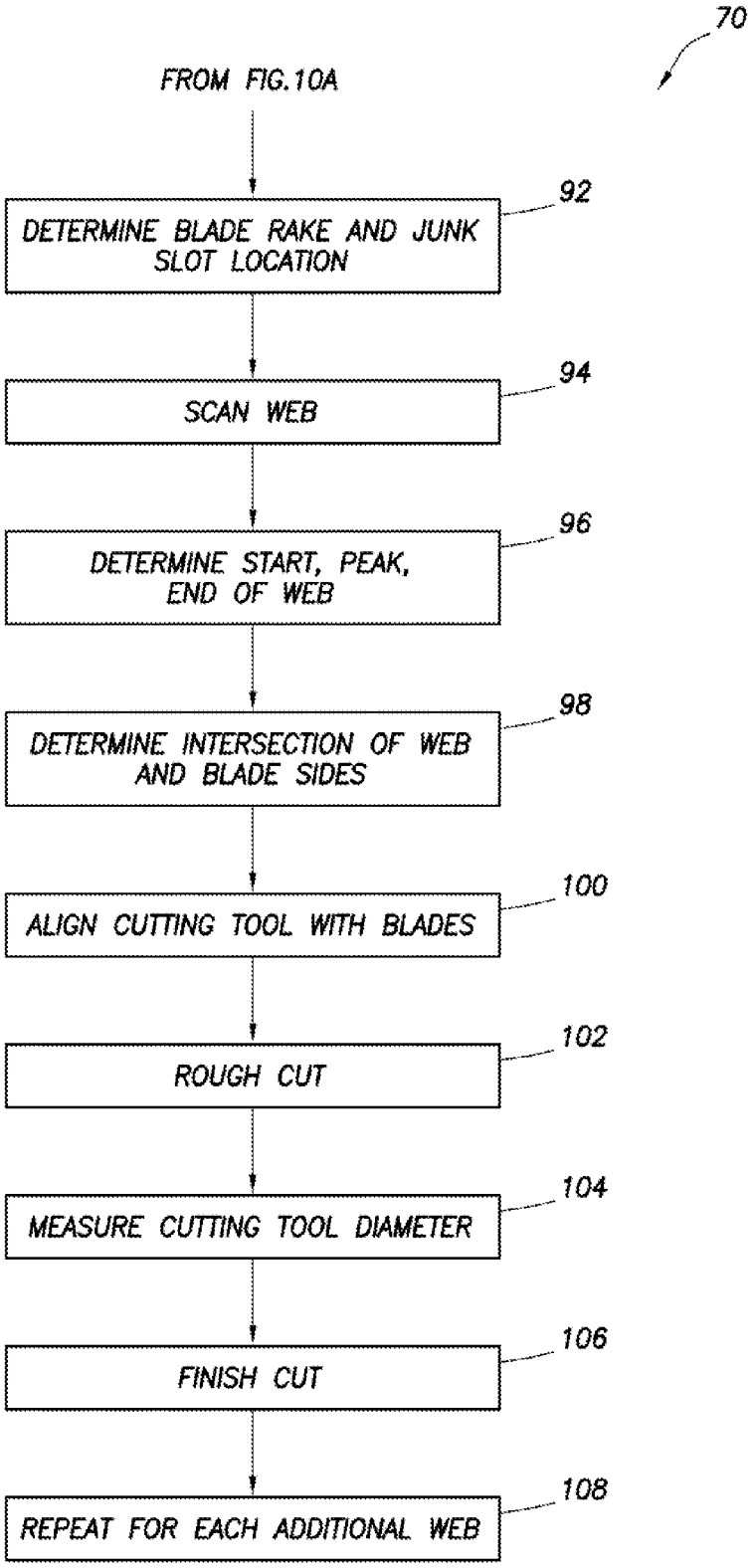

Referring additionally now to FIGS. 10A & B, a method 70 of removing the unwanted material 16 from the drill bit 10 is representatively illustrated in flowchart form. Although the method 70 is suited for removing the unwanted material 16 from the drill bit 10, with appropriate modification, the method could be used for removing unwanted material from other types of articles.

In one aspect, the method 70 accomplishes a desirable result of removing the unwanted material 16, even though the precise geometry of the drill bit 10 is unknown before commencement of the method. An operator can input (e.g., via the interface 38) an approximate size of the drill bit 10, as well as other identifying characteristics, so that the controller 36 has a basis for beginning the process of determining the drill bit's geometry.

In step 72, the drill bit 10 is loaded into the rotary indexing device 28, so that the longitudinal bit axis 44 is centered in the device's rotor.

In step 74, the drill bit 10 is painted so that the scanning device 48 can readily detect the outer surface 46 of the bit. This step 74 is optional if the scanning device 48 can accurately detect the outer surface 46 without it being painted.

In step 76, the operator inputs an initial axial position into the interface 38. The controller 36 uses this information to determine where to start the axial scan 58. In this example, the initial axial position is on the shank 18, somewhat toward the indexing device 28 from the bevel 22. The controller 36 ignores any data for axial positions opposite the blades 12 from the initial axial position.

In step 78, the axial scan 58 is performed. The robot 34 displaces the scanning device 48 so that the scan 58 traverses the drill bit 10 from the shank 18 to a blade 12.

In step 80, the controller 36 determines the bit diameter DB, the shank diameter DS and an inflection point 110 of the bevel 22 (diameter reductions along the shank 18 can be ignored in determination of the inflection point 110 position). These determinations are, in this example, based on the information obtained from the axial scan 58, as discussed above in relation to FIG. 7. In addition, the operator can input to the interface 38 an angle of the bevel 22 (e.g., 30 or 45 degrees, etc.).

In step 82, the controller 36 determines the location of the bevel top 60. In this example, the location of the bevel top 60 can be readily calculated, since the location of the inflection point 110 and the angle of the bevel 22 are known.

In step 84, the robot 34 positions the scanning device 48 (a laser in this example) for circumferentially scanning the outer surface 46 of the drill bit 10. The drill bit 10 can be rotated by the rotary indexing device 28 relative to the scanning device 48. In other examples, the scanning device 48 could be rotated about the drill bit 10 (e.g., by the robot 34).

In step 86, the drill bit 10 is circumferentially scanned by the scanning device 48 at a first axial position along the drill bit. In this example, the axial position is chosen to be in the area of the blades 12, so that the circumferential scan 62 will allow for geometrically characterizing each of the blades and recesses 14 about the drill bit 10, as discussed above in relation to FIG. 8.

For example, the number of the blades 12 and recesses 14, the blade diameters DB and angular positions of the blades (e.g., as indicated by sections 62*a* of the scan 62), the positions of the recesses (e.g., as indicated by sections 62*b*), the rakes r (e.g., see FIG. 4) of the blade sides 20 (e.g., as indicated by sections 62*c*), the widths W between adjacent blades 12 (e.g., as indicated by the distances between the sections 62*c*), the depths D of the recesses 14 (e.g., as indicated by differences between the sections 62*a* & *b*) and radii R (e.g., as indicated by sections 62*d*) can be readily determined from such a circumferential scan 62.

In step 87, the scanning device 48 is repositioned to a second axial position, offset from the first axial position in step 86.

In step 88, the drill bit 10 is circumferentially scanned by the scanning device 48 at the second axial position along the drill bit. The second axial position is also in the area of the blades 12 in this example, but is axially offset from the first circumferential scan in step 86, so that certain changes in geometrical characteristics can be determined.

In step 90, the circumferential scans 62 & 64 are compared. For example, by calculating the change in angular positions of the blades 12 between the two circumferential scans 62 & 64, the helical pitch P of the blades can be readily determined by the controller 36, as discussed above in relation to FIG. 8.

In step 92, the blade rake r is determined by the controller 36, based on the circumferential scan 62. For example, the controller 36 can pick two points on a side 20 of a blade 12 (e.g., as indicated by the corresponding scan section 62*c*), and compare their positions in order to calculate the blade rake r. The locations of the recesses 14 (also known to those skilled in the art as "junk slots") can be readily determined, as well (e.g., at sections 62*b* of the circumferential scan 62).

In step 94, the robot 34 positions the scanning device 48, and the rotary indexing device 28 rotates the drill bit, so that the scanning device can scan the outer surface 46 of the drill bit helically along one of the recesses 14. The rotary indexing device 28 then rotates the drill bit 10 while the robot 34 displaces the scanning device 48 axially relative to the drill bit, thereby helically scanning the outer surface of the drill bit. However, the robot 34 could displace the scanning device 48 helically about the drill bit 10 (e.g., so that the drill bit is not rotated during the helical scan), if desired.

In this example, the unwanted material 16 comprises a web between the blades 12, resulting from a molding process. However, in other examples, the unwanted material 16 may be be removed from another type of drill bit, or another type of oilfield equipment, or other type of article. Furthermore, the unwanted material 16 may not comprise a web, the article or drill bit may not be produced by a molding process, etc. Thus, it should be clearly understood that the principles of this disclosure are not limited to the details of the method 70 or the drill bit 10 described herein or depicted in the drawings.

In step 96, the controller 36 determines the start, peak and end of the unwanted material 16 (a web in this example). As described above, a peak of the section 66*c* (see FIG. 9) can be identified as a peak 68 of the corresponding unwanted material 16.

In step 98, the controller 36 determines where the web intersects the wanted material of the blade 12 sides 20, recesses 14 and radii R. Tool paths for the cutting tool 32 are then calculated, so that the unwanted material 16 will be removed, up to the intersections between the unwanted material and the blade sides 20, recesses 14 and radii R.

In step 100, the controller 36 rotates the drill bit (if needed) and aligns the cutting tool 32 with a recess 14 between two blades 12. For example, the robot 34 could rotate the cutting tool 32 so that it is at a same angle (considering the cutting tool as being normal to the axis 42) relative to the longitudinal axis 44 of the drill bit 10 as the helical pitch P of the blades 12 adjacent the selected recess 14.

The robot 34 can also rotate the cutting tool 32 so that it is angled to correspond with the rake r of the adjacent blade sides 20. In this manner, the cutting tool 32 can be conveniently displaced between the blades 12 for removal of the unwanted material 16, without removing any of the wanted material of the blade sides 22, radii R or recesses 14.

In step 102, the cutting tool 32 rough cuts the unwanted material 16. In this example, the cutting tool 32 is plunged radially (relative to the bit axis 44) into the unwanted material 16 between the blades 12, and then is displaced axially to remove the axial width of the unwanted material. This process is repeated, with the drill bit 10 being rotated by the rotary indexing device 28 as needed between sets of radial plunges and axial displacements, to remove the unwanted material 16 up to near the intersection between the unwanted material and the blade sides 20, radii R and recess 14.

In step 104, the cutting tool 32 diameter is again measured, since abrasive rough cutting can reduce the cutting tool diameter. In this example, the cutting tool 32 is displaced by the robot 34 into contact with the plate 56, the device 52 senses such contact and/or displacement, and the controller 36 uses this information to compute the diameter of the cutting tool. If an abrasive cutting tool is not used, then step 104 may not be performed in the method 70.

In step 106, the cutting tool 32 finish cuts the unwanted material 16. In this example, the cutting tool 32 initially plunge cuts partially into the unwanted material 16 near one of the radii R and at the axial start of the unwanted material, the drill bit 10 rotates to displace the center of the recess 14 toward the cutting tool. This is repeated at both sides 20 adjacent the recess 14, and at the axial middle and end of the unwanted material 16. Multiple passes at incrementally decreasing radial distances from the bit axis 44 can be performed, until the cutting tool 32 has removed substantially all of the unwanted material 16.

In step 108, the preceding steps 94-106 are repeated for each successive portion of unwanted material 16 between adjacent blades 12. Certain determinations made in, for example, steps 80, 82, 90, 92 can also be used by the controller 36 in determining tool paths for the cutting tool 32 in the repeated steps 94-106. Although in this example, certain scans 58, 62, 64 may not be repeated in the repeated steps 94-106, in other examples any or all of these scans could be repeated, as desired.

Note that it is not necessary for substantially all of the unwanted material 16 to be removed from between the blades 12. For example, in order to protect wanted material of the drill bit 10, the controller 36 could prevent the cutting tool 32 from removing unwanted material adjacent to the wanted material. Such a situation could arise, for example, if the bit is undercut, a weld groove is present, etc.

Furthermore, note that it is not necessary for all of the steps 72-108 described above to be performed in keeping with the scope of this disclosure. In other examples, more, fewer or different steps could be performed, and the steps could be performed in different orders. For example, step 92 could be part of step 86, the second circumferential scan 64 may not be performed if the blade pitch P is known, etc. Thus, it will be appreciated that the scope of this disclosure is not limited at all to the details of the method 70 described here or depicted in the drawings.

If the blades 12 do not have a helical pitch P, then the helical scan 66 can instead be an axial scan, since the recesses 14 would not extend helically about the drill bit 10. In addition, if there is no helical pitch P, the cutting tool 32 may not be rotated to align with the nonexistent helical pitch. Similar considerations apply if the blades 12 have no rake r (e.g., the cutting tool 32 would not be rotated to align with the nonexistent rake).

It may now be fully appreciated that the material removal system 30 and method 70 result from significant advancements in the art of material removal. Especially (although not exclusively) useful for custom manufactured articles having variations in form, the system 30 and method 70 allow the unwanted material 16 to be efficiently and safely removed, without removing any of the wanted material of the drill bit 10.

In one example, a method 70 of removing unwanted material 16 from an oilfield drill bit 10 is provided to the art by the above disclosure. The method 70 can include scanning the drill bit 10; determining, based on the scanning, a location of the unwanted material 16; determining tool paths of a cutting tool 32 which will result in removal of the unwanted material 16; and displacing the cutting tool 32 along the tool paths, thereby removing the unwanted material 16.

The unwanted material 16 may be positioned between blades 12 of the drill bit 10.

Determining the location of the unwanted material 16 can include determining radii R between a recess 14 and adjacent sides 20 of the blades 12.

Scanning can comprise scanning helically along a surface 46 of the drill bit 10 between the blades 12.

Determining the location of the unwanted material 16 can include determining a width W between the blades 12, determining a number of the blades 12, determining an angular spacing of the blades 12, determining a helical pitch P of the blades 12, determining a rake r of the blades 12, and/or determining a depth D between the blades 12.

Displacing the cutting tool 32 can include displacing the cutting tool 32 to approximately the depth D between the blades 12, thereby removing the unwanted material 16 positioned outward from the depth D.

Displacing the cutting tool 32 can include displacing the cutting tool 32 along the tool paths aligned with the helical pitch P.

Determining the helical pitch P can include circumferentially scanning the blades 12 at axially spaced apart positions.

Scanning can comprise scanning axially along a surface 46 of the drill bit 10. Determining the location of the unwanted material 16 can comprise determining at least one of the group comprising a drill bit diameter DB, a shank diameter DS, an inflection point 110 and a bevel top 60, based on the axial scanning.

Scanning can comprise scanning circumferentially about blades 12 of the drill bit 10. Determining the location of the unwanted material 16 can include determining at least one of the group comprising number of the blades 12, angular spacing of the blades 12, widths W between the blades 12, radii R at sides 20 of the blades 20, rake r of the blades 12 and helical pitch P of the blades 12, based on the circumferential scanning.

A material removal system 30 is also provided to the art for removing unwanted material 16 from an oilfield drill bit 10. In one example, the system 30 can include a rotary indexing device 28 which rotates the drill bit 10 about a longitudinal axis 44 of the drill bit 10, a scanning device 48 which scans an outer surface 46 of the drill bit 10 and a controller 36 which a) determines a geometry of the drill bit 10, based on at least one scan 58, 62, 64, 66 by the scanning device 48, b) determines a location of the unwanted material 16, and c) determines tool paths of a cutting tool 32 for removal of the unwanted material 16.

The scanning device 48 may comprises a laser, radar, an ultrasound sensor, a physical probe and/or an optical scanning device.

The location of the unwanted material 16 and/or the geometry of the drill bit 10 may be unknown until determined by the controller 36.

There may be relative rotation between the drill bit 10 and the scanning device 48 while the scanning device 48 scans the outer surface 46 of the drill bit 10. The rotary indexing device 28 may rotate the drill bit 10 while the cutting tool 32 removes the unwanted material 16.

The drill bit 10 geometry determined by the controller 36 may comprise radii R between a recess 14 and adjacent sides 20 of the blades 12, a width W between the blades 12, a number of the blades 12, an angular spacing of the blades 12, a depth D between the blades 12, a helical pitch P of the blades 12, and/or a rake r of the blades 12.

The controller 36 can displace the cutting tool 32 along the tool paths aligned with the helical pitch P.

The controller 36 can determine the helical pitch P based on multiple circumferential scans 62, 64 of the blades 12 at axially spaced apart positions.

The scanning device 48 can scan axially along the outer surface 46 of the drill bit 10, whereby an axial scan 58 is produced. The drill bit 10 geometry determined by the controller 36 can comprise a drill bit diameter DB, a shank diameter DS, an inflection point 110, and/or a bevel top 60, based on the axial scan 58.

The scanning device 48 can scan circumferentially about blades 12 of the drill bit 10, whereby one or more circumferential scans 62, 64 are produced. The drill bit 10 geometry determined by the controller 36 can comprise a number of the blades 12, an angular spacing of the blades 12, widths W between the blades 12, radii R at sides 20 of the blades 12, rake r of the blades 12, and/or helical pitch P of the blades 12, based on the one or more circumferential scans 62, 64.

As mentioned above, the scope of this disclosure is not limited to use only in removing unwanted material from an oilfield drill bit. In a broader aspect, a method 70 of removing unwanted material 16 from an article (e.g., the drill bit 10 or another article) having a variable form is described by this disclosure. In one example, the method 70 can include scanning the article; determining, based on the scanning, a location of the unwanted material 16; determining tool paths of a cutting tool 32 which will result in removal of the unwanted material 16; and displacing the cutting tool 32 along the tool paths, thereby removing the unwanted material 16.

Scanning can comprise scanning axially helically and/or circumferentially along a surface 46 of the article.

The article may be rotated during the scanning.

Scanning circumferentially may be performed at multiple axial positions along the article.

The article may be rotated while removing the unwanted material 16. The article may be displaced while displacing the cutting tool 32.

Removing the unwanted material 16 may comprise grinding away the unwanted material 16.

The scanning may be performed by a laser, radar, an ultrasound sensor, a physical probe, and/or an optical scanning device.

The location of the unwanted material 16 may be unknown prior to the scanning. The form of the article may be unknown prior to the scanning.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A method of removing unwanted material from an oilfield drill bit, the method comprising:

scanning an outer surface of the oilfield drill bit with a device located external to the oilfield drill bit;

determining, based on the scanning, a location of the unwanted material positioned between a plurality of blades on the outer surface of the oilfield drill bit;

calculating, based on the scanning, a helical pitch of the of blades;

determining tool paths of a cutting tool which will result in removal of the unwanted material, the tool paths aligned with the helical pitch of the plurality of blades; and displacing the cutting tool along the tool paths, to remove the unwanted material.

2. The method of claim 1, wherein determining the location of the unwanted material further comprises determining radii between a recess and adjacent sides of the plurality of blades.

3. The method of claim 1, wherein scanning further comprises scanning helically along a surface of the oilfield drill bit between the plurality of blades.

4. The method of claim 1, wherein determining the location of the unwanted material further comprises determining a width between the plurality of blades.

5. The method of claim 1, wherein determining the location of the unwanted material further comprises determining a number of the plurality of blades.

6. The method of claim 1, wherein determining the location of the unwanted material further comprises determining an angular spacing of the plurality of blades.

7. The method of claim 1, wherein determining the location of the unwanted material further comprises determining a depth between the plurality of blades.

8. The method of claim 7, wherein displacing the cutting tool comprises displacing the cutting tool to approximately the depth between the plurality of blades, thereby removing the unwanted material positioned outward from the depth.

9. The method of claim 1, wherein displacing the cutting tool comprises displacing the cutting tool along the tool paths aligned with the helical pitch.

10. The method of claim 1, wherein determining the helical pitch comprises circumferentially scanning the plurality of blades at axially spaced apart positions.

11. The method of claim 1, wherein determining the location of the unwanted material further comprises determining a rake of the plurality of blades.

12. The method of claim 1, wherein scanning comprises scanning axially along a surface of the oilfield drill bit.

13. The method of claim 12, wherein determining the location of the unwanted material comprises determining at least one of the group comprising a drill bit diameter, a shank diameter, an inflection point and a bevel top, based on the axial scanning.

14. The method of claim 1, wherein scanning comprises scanning circumferentially about the plurality of blades of the oilfield drill bit.

15. The method of claim 14, wherein determining the location of the unwanted material comprises determining at least one of the group comprising number of the plurality of blades, angular spacing of the plurality of blades, widths between the plurality of blades, radii at sides of the plurality of blades, and rake of the plurality of blades, based on the circumferential scanning.

16. A material removal system for removing unwanted material from an oilfield drill bit, the system comprising:

a rotary indexing device which rotates the oilfield drill bit about a longitudinal axis of the oilfield drill bit;

a scanning device which scans an outer surface of the oilfield drill bit, the scanning device located external to the oilfield drill bit; a cutting tool which removes the unwanted material from the oilfield drill bit; and a controller which a) determines a geometry of the oilfield drill bit, based on at least one scan by the scanning device, b) determines a location of the unwanted material positioned between a plurality of blades on the outer surface of the oilfield drill bit, c) calculates a helical pitch of the of blades, d) determines tool paths of the tool for removal of the unwanted material, the tool paths aligned with the helical pitch of the plurality of blades, and e) displaces the cutting tool along the tool path to remove the unwanted material.

17. The system of claim 16, wherein the scanning device comprises at least one of the group comprising a laser, radar, an ultrasound sensor, a physical probe and an optical scanning device.

18. The system of claim 16, wherein the location of the unwanted material is unknown until determined by the controller.

19. The system of claim 16, wherein the geometry of the oilfield drill bit is unknown until determined by the controller.

20. The system of claim 16, wherein there is relative rotation between the oilfield drill bit and the scanning device while the scanning device scans the outer surface of the oilfield drill bit.

21. The system of claim 16, wherein the rotary indexing device rotates the oilfield drill bit while the cutting tool removes the unwanted material.

22. The system of claim 16, wherein the oilfield drill bit geometry determined by the controller comprises radii between a recess and adjacent sides of the plurality of blades.

23. The system of claim 16, wherein the scanning device scans helically along the outer surface of the oilfield drill bit between plurality of blades.

24. The system of claim 16, wherein the oilfield drill bit geometry determined by the controller comprises a width between the plurality of blades.

25. The system of claim 16, wherein the oilfield drill bit geometry determined by the controller comprises a number of the plurality of blades.

26. The system of claim 16, wherein the oilfield drill bit geometry determined by the controller comprises an angular spacing of plurality blades.

27. The system of claim 16, wherein the oilfield drill bit geometry determined by the controller comprises a depth between the plurality of blades.

28. The system of claim 16, wherein the controller displaces the cutting tool along the tool paths aligned with the helical pitch.

29. The system of claim 16, wherein the controller determines the helical pitch based on multiple circumferential scans of the plurality of blades at axially spaced apart positions.

30. The system of claim 16, wherein the oilfield drill bit geometry determined by the controller comprises a rake of the plurality of blades.

31. The system of claim 16, wherein the scanning device scans axially along the outer surface of the oilfield drill bit, whereby an axial scan is produced.

32. The system of claim 31, wherein the oilfield drill bit geometry determined by the controller comprises at least one of the group comprising a drill bit diameter, a shank diameter, an inflection point and a bevel top, based on the axial scan.

33. The system of claim 16, wherein the scanning device scans circumferentially about plurality of blades of the oilfield drill bit, whereby one or more circumferential scans are produced.

34. The system of claim 33, wherein the oilfield drill bit geometry determined by the controller comprises at least one of the group comprising number of the plurality of blades, angular spacing of the plurality of blades, widths between the plurality of blades, radii at sides of the plurality of blades, rake of the plurality of blades and rake of the plurality of blades, based on the one or more circumferential scans.

* * * * *